US006329335B1

(12) United States Patent
Feist et al.

(10) Patent No.: US 6,329,335 B1
(45) Date of Patent: Dec. 11, 2001

(54) DETERGENT TABLETS

(75) Inventors: Michael Feist, Meerbusch; Hans-Friedrich Kruse, Korschenbroich, both of (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/037,139

(22) Filed: Mar. 9, 1998

(30) Foreign Application Priority Data

Mar. 7, 1997 (DE) ..... 197 09 411

(51) Int. Cl.[7] ..... C11D 11/00; C11D 17/00; C11D 3/08

(52) U.S. Cl. ..... 510/446; 510/294; 510/298; 510/356; 510/360; 510/361; 510/511

(58) Field of Search ..... 510/298, 294, 510/360, 361, 446, 356, 511

(56) References Cited

U.S. PATENT DOCUMENTS

| | | | | |
|---|---|---|---|---|
| 3,331,780 | * | 7/1967 | Krusius | 252/135 |
| 4,219,436 | * | 8/1980 | Gromer et al. | 510/224 |
| 4,524,009 | | 6/1985 | Valenty | 252/89.1 |
| 4,587,031 | * | 5/1986 | Kruse et al. | 510/224 |
| 4,639,325 | | 1/1987 | Valenty et al. | 252/89.1 |
| 4,816,553 | | 3/1989 | Baur et al. | 528/245 |
| 4,828,749 | * | 5/1989 | Kruse et al. | 510/224 |
| 4,985,553 | | 1/1991 | Fuertes et al. | 536/124 |
| 5,133,892 | * | 7/1992 | Chun et al. | 510/224 |
| 5,494,488 | | 2/1996 | Arnoldi et al. | 8/137 |
| 5,501,814 | | 3/1996 | Engelskirchen et al. | 252/174.17 |
| 5,541,316 | | 7/1996 | Engelskirchen et al. | 510/471 |
| 5,580,941 | | 12/1996 | Krause et al. | 527/300 |
| 5,650,017 | * | 7/1997 | Gordon et al. | 134/7 |
| 5,693,304 | * | 12/1997 | Borgstedt et al. | 423/332 |
| 5,780,420 | * | 7/1998 | Breuer et al. | 510/466 |
| 5,807,529 | * | 9/1998 | Kruse et al. | 423/332 |
| 5,814,597 | * | 9/1998 | Raehse et al. | 510/511 |
| 5,866,531 | * | 2/1999 | Assmann et al. | 510/446 |
| 5,900,399 | * | 5/1999 | Seiter et al. | 510/446 |

FOREIGN PATENT DOCUMENTS

| | | | |
|---|---|---|---|
| 94 58592 | | 8/1994 | (AU) . |
| 42 21 381 | | 2/1994 | (DE) . |
| 43 00 772 | | 7/1994 | (DE) . |
| 43 03 320 | | 8/1994 | (DE) . |
| 44 00 024 | | 7/1995 | (DE) . |
| 44 16 438 | | 11/1995 | (DE) . |
| 44 17 734 | | 11/1995 | (DE) . |
| 44 43 177 | | 6/1996 | (DE) . |
| 195 29 905 | | 2/1997 | (DE) . |
| 195 36 082 | | 4/1997 | (DE) . |
| 195 40 086 | | 4/1997 | (DE) . |
| 196 00 018 | | 7/1997 | (DE) . |
| 196 05 688 | | 8/1997 | (DE) . |
| 196 13 103 | | 10/1997 | (DE) . |
| 196 20 411 | | 10/1997 | (DE) . |
| 196 16 693 | | 11/1997 | (DE) . |
| 196 16 767 | | 11/1997 | (DE) . |
| 196 16 769 | | 11/1997 | (DE) . |
| 196 16 770 | | 11/1997 | (DE) . |
| 196 20 267 | | 11/1997 | (DE) . |
| 0 150 930 | | 8/1985 | (EP) . |
| 0 232 202 | | 8/1987 | (EP) . |
| 0 272 030 | | 6/1988 | (EP) . |
| 0 280 223 | | 8/1988 | (EP) . |
| 0 392 592 | | 10/1990 | (EP) . |
| 0 427 439 | | 5/1991 | (EP) . |
| 0 443 651 | | 8/1991 | (EP) . |
| 0 446 982 | | 9/1991 | (EP) . |
| 0 453 003 | | 10/1991 | (EP) . |
| 0 458 397 | | 11/1991 | (EP) . |
| 0 458 398 | | 11/1991 | (EP) . |
| 0 472 042 | | 2/1992 | (EP) . |
| 0 522 766 | | 1/1993 | (EP) . |
| 0 525 239 | | 2/1993 | (EP) . |
| 0542131 | * | 5/1993 | (EP) . |
| 0 542 496 | | 5/1993 | (EP) . |
| 0 549 271 | | 6/1993 | (EP) . |
| 0 549 272 | | 6/1993 | (EP) . |
| 0 554 490 | | 6/1993 | (EP) . |
| 0 554 519 | | 6/1993 | (EP) . |
| 0 693 550 | | 1/1996 | (EP) . |
| 0 703 292 | | 3/1996 | (EP) . |
| 0 711 827 | | 5/1996 | (EP) . |
| 0 711 828 | | 5/1996 | (EP) . |
| 0 716 144 | | 6/1996 | (EP) . |
| 0737738 | * | 10/1996 | (EP) . |
| 58/217598 | | 12/1983 | (JP) . |
| 93 339 896 | | 12/1993 | (JP) . |
| 90/13533 | | 11/1990 | (WO) . |
| 92/18542 | | 10/1992 | (WO) . |
| 93/08251 | | 4/1993 | (WO) . |
| 93/16110 | | 8/1993 | (WO) . |
| 94/27970 | | 12/1994 | (WO) . |
| 94/28030 | | 12/1994 | (WO) . |
| 94/28102 | | 12/1994 | (WO) . |
| 94/28103 | | 12/1994 | (WO) . |
| 94/29419 | | 12/1994 | (WO) . |
| 95/00626 | | 1/1995 | (WO) . |
| 95/07303 | | 3/1995 | (WO) . |
| 95/07331 | | 3/1995 | (WO) . |
| 95/12619 | | 5/1995 | (WO) . |
| 95/14075 | | 5/1995 | (WO) . |
| 95/14759 | | 6/1995 | (WO) . |
| 95/17498 | | 6/1995 | (WO) . |
| 95/20029 | | 7/1995 | (WO) . |
| 95/20608 | | 8/1995 | (WO) . |
| 95/27775 | | 10/1995 | (WO) . |
| 97/05226 | * | 2/1997 | (WO) . |

* cited by examiner

*Primary Examiner*—Lorna M. Douyon
(74) *Attorney, Agent, or Firm*—Wayne C. Jaeschke; Glenn E. J. Murphy

(57) ABSTRACT

A process for the production of detergent tablets containing surfactants, builders and optionally other detergent ingredients. To produce the tablets, particulate detergent compositions containing 5 to 20% by weight of an overdried amorphous silicate, 0.5 to 10% by weight of polyethylene glycol and 1 to 15% by weight of water or aqueous solutions, based on the weight of the tablet formed, are tabletted under pressure. Despite low tabletting pressures, the process according to the invention gives tablets combining high fracture resistance and stability in storage with excellent dissolving behavior.

17 Claims, No Drawings

DETERGENT TABLETS

BACKGROUND OF THE INVENTION

1. Field of the Invention

This invention relates generally to tabletted detergents. More particularly, the invention relates to a process for the production of detergent tablets, in which advantageous product properties, such as hardness, fracture resistance and good solubility, are combined with process advantages, such as minimal outlay on machinery, low tabletting forces and low temperatures.

Detergent tablets have been widely described in the prior-art literature and are becoming increasingly popular among consumers because they are easy to dose. Tabletted detergents have a number of advantages over powder-form detergents: they are easier to dose and handle and, by virtue of their compact structure, have advantages in regard to storage and transportation. Accordingly, detergent tablets are also comprehensively described in the patent literature.

2. Discussion of Related Art

Thus, EP-A-0 522 766 (Unilever) describes tablets of a compacted particulate detergent composition, the particles being at least partly coated with a material which acts both as a binder and as a disintegrating agent when the tablets are dissolved in water. The document in question also refers to the general difficulties involved in producing tablets combining adequate stability with good dissolvability. The particle size in the mixture to be tabletted should be above 200 $\mu$m and the upper and lower limits to the individual particle sizes should not be more than 700 $\mu$m apart from one another.

Other documents concerned with the production of detergent tablets include EP-A-0 716 144 (Unilever), which describes tablets with an outer shell of water-soluble material, and EP-A-0 711 827 (Unilever) which mentions a citrate having defined solubility as an ingredient.

The use of binders, more particularly polyethylene glycol, is disclosed in EP-A-0 711 828 (Unilever) which describes detergent tablets produced by tabletting a particulate detergent composition at temperatures between 28° C. and the melting point of the binder, tabletting always being carried out below the melting temperature. It is apparent from the Examples of this document that the tablets produced in accordance with its teaching have higher fracture resistances when tabletting is carried out at elevated temperature.

All the documents cited above use high tabletting pressures above 15 N/cm$^2$ in the tabletting process to obtain sufficiently stable tablets. The tabletting processes are optionally carried out at elevated temperature because stability is said to be further increased by a form of "sintering".

The problem addressed by the present invention was to provide a simplified process for the production of tablets which would out-perform known tablets in regard to fracture resistance, stability in storage and dissolving behavior.

DESCRIPTION OF THE INVENTION

Accordingly, the present invention relates to a process for the production of detergent tablets containing surfactants, builders and optionally other detergent ingredients by tabletting a particulate detergent composition, a) 5 to 20% by weight of an overdried amorphous silicate, b) 0.5 to 10% by weight of polyethylene glycol and c) 1 to 15% by weight of water or aqueous solutions, based on the weight of the tablet formed, being used for the production of the tablets.

To produce the detergent tablets, a powder-form or granular free-flowing compound is tabletted in suitable molds in the process according to the invention. The tabletting process may be carried at any temperature and under any pressure. Whereas, normally, only high tabletting pressures and/or temperatures lead to sufficiently stable tablets, detergent tablets which out-perform conventional tablets in regard to stability, even when produced under tabletting pressures below 15 N/cm$^2$, can be obtained by the process according to the invention. There is also no need for tabletting to be carried out at elevated temperature in the process according to the invention although tabletting at a relatively high temperature can be useful and does not lead to any loss of the advantages of the process according to the invention. Normally, an increase in temperature for the same tabletting pressure provides the tablets with a higher fracture resistance. The combination of a reduced tabletting pressure and elevated temperature leads to tablets which have a high dissolving rate despite their high fracture resistance. However, the process according to the invention is preferably carried out with tabletting pressures below 15 N/cm$^2$ and at temperatures below 30° C. which leads to moldings that out-perform conventional detergent tablets in regard to stability and dissolving behavior. The low tabletting temperatures have an advantageous effect in particular when the tablets contain temperature-labile ingredients which would tend to decompose at elevated temperatures.

The particulate detergent composition to be tabletted essentially contains 5 to 20% by weight of an overdried amorphous silicate, 0.5 to 10% by weight of polyethylene glycol and 1 to 15% by weight of water or aqueous solutions of other active ingredients and auxiliaries. By virtue of this special composition, detergent tablets combining high stability with excellent dissolving behavior are obtained even at low tabletting pressures and without the use of high temperatures. The particulate detergent composition to be tabletted may be prepared in known manner and, in principle, may have any bulk density. Thus, parts of the composition or even the complete composition may be prepared by spray drying or roll compacting. However, the particulate detergent composition is prepared with particular advantage by granulation and compacting of the ingredients or individual compounds in mixer/granulators. Granulation may be carried out both in high-intensity mixers and in low-speed mixers. Examples of high-speed mixers are the Lödige® CB Recycler (trademark of Lödige Maschinenbau GmbH, Paderborn), the Fukae® FS-G mixers (trademark of Fukae Powtech, Kogyo CO., Japan), the Eirich® Type R mixer (trademark of Maschinenfabrik Gustav Eirich, Hardheim) or the Drais® K-TTP 80 (trademark of Drais-Werke GmbH, Mannheim). Examples of low-speed mixer/granulators are the Drais® K-T 160 and the Lödige® KM 300. The latter, which is often referred to as a "Lödige plowshare mixer", is particularly suitable for carrying out this stage of the process.

In one particularly preferred embodiment of the production of the compound to be tabletted, the overdried amorphous silicate is initially introduced into the mixer used for the mixing/granulation stage, other optional builders and auxiliaries are added and, after the mixer has been switched on, water or aqueous solutions are added, after which the surfactants or surfactant compounds are introduced. The other detergent ingredients, such as bleaching agents, enzymes, soil repellents and the like are then added in the so-called working-up stage. The polyethylene glycol used as component b) may be added together with the surfactant compounds in the first step or with the other ingredients in the working-up step. It is preferably added in the working-up step. The polyethylene glycol may be added in any of the usual commercial forms of which the melting points vary according to the molecular weight distribution. Polyethylene glycol having an average molecular weight of 1,500 dalton (PEG 1500) melts at 45° C. for example whereas polyethylene glycols with molecular weights of 4,000 dalton (PEG 4000) and 6,000 dalton (PEG 6000) melt at around 55° C. and 62° C., respectively. PEG 4000 is preferably used, being added in quantities of 0.5 to 10% by weight and preferably in quantities of 1 to 4% by weight, based on tablet weight. In addition, organic polymers which, in combination with the polyethylene glycol, contribute to the strength of the tablets obtained may be added during the tabletting process. Examples of such organic polymers are polyvinyl pyrrolidone, polyacrylates and copolymers of maleic acid and acrylic acid.

The bulk density of the compound to be tabletted may vary within wide limits depending on the intended density of the tablets obtained. In the interests of packaging and transportation economy, the compound should have bulk densities above 400 g/l, higher bulk densities, more particularly above 500 g/l and—better still—above 600 g/l being preferred. Bulk densities such as these lead to tablet densities above 800 g/l which are again desirable in the interests of economic packaging and transportation.

The granules or mixtures of granules are normally tabletted at room temperature or at best slightly elevated temperatures, for example at temperatures of up to about 50° C. The tabletting process is preferably carried out at room temperature, i.e. at a temperature in the range from about 18 to 30° C. The duration of the tabletting process is determined by the particular type of machine selected. It is generally less than 1 minute and normally of the order of a few seconds or even far shorter.

The portioned tablets may be made in predetermined shapes and sizes.

Suitable tablet shapes are virtually any easy-to-handle shapes, for example tablets per se, bars, cubes, squares or corresponding shapes with flat sides and, in particular, cylindrical shapes with circular or oval cross-sections. This particular geometry encompasses shapes from tablets per se to compact cylinders with a height-to-diameter ratio of 1.

The portioned tablets may be produced as separate individual elements corresponding to the particular amount of detergent used.

However, it is also possible to produce tablets which combine several such units in a single tablet, relatively small portioned units being easy to separate from one another by predetermined weak spots. For the use of laundry detergents in standard European washing machines with horizontally arranged mechanics, the portioned tablets may be usefully produced as cylindrical or square tablets, preferably with a diameter-to-height ratio of about 0.5:2 to 2:0.5. Commercial hydraulic presses, eccentric presses or rotary presses are suitable, particularly for the production of such tablets.

The shape of another embodiment of the tablets is adapted in its dimensions to the dispensing compartment of commercial domestic washing machines so that the tablets can be directly introduced without any metering aids into the dispensing compartment of the washing machine in which they dissolve during the dispensing process. However, the detergent tablets may of course also be readily dispensed using a metering aid which is preferred for the purposes of the present invention.

Another preferred tablet which can be produced has a plate-like or slab-like structure with alternately thick long and thin short segments, so that individual segments can be broken off from this "bar" at the predetermined weak spots, which the short thin segments represent, and introduced into the washing machine. This principle of the "bar-like" tabletted detergent can also be embodied in other geometric shapes, for example vertical triangles which are only joined longitudinally to one another on one side.

However, the various components need not necessarily be tabletted to form a homogeneous tablet. Instead, the tablets obtained may comprise several layers, i.e. at least two layers. These various layers may also have different dissolving rates which can result in favorable performance properties of the tablets. If, for example, the tablets contain components which adversely affect one another, one of these components may be integrated in the faster dissolving layer while the other component may be incorporated in a more slowly dissolving layer, so that the first component has reacted off by the time the second dissolves. The various layers of the tablet may be arranged in the form of a stack, in which case the inner layer(s) dissolve(s) at the edges of the tablet before the outer layers have had time to dissolve completely. Alternatively, the inner layer(s) may also be completely surrounded by the outer layer(s) so that parts of the inner layer(s) are prevented from prematurely dissolving.

In another preferred embodiment of the invention, a tablet consists of at least three layers, i.e. two outer layers and at least one inner layer, at least one of the inner layers containing a peroxy bleaching agent, whereas in the stack-like tablet the two outer layers and, in the shell-like tablet, the outermost layers are free from peroxy bleaching agent. In addition, peroxy bleaching agent and any bleach activators and/or enzymes present may be accommodated separately from one another in one and the same tablet. Multilayer tablets such as these have the advantage that they may be used not only via a dispensing compartment or a metering element introduced into the wash liquor, instead, it is also possible in cases such as these to introduce the tablet into the machine in direct contact with the textiles without any danger of staining by bleaching agent or the like.

Similar effects can also be obtained by coating individual components of the detergent composition to be tabletted or the tablet as a whole. To this end, the parts to be coated may be sprayed, for example with aqueous solutions or emulsions, or may be melt-coated.

The silicates used in accordance with the invention are overdried amorphous sodium silicates with an $Na_2O:SiO_2$ ratio (modulus) of 1:2 to 1:3.3, preferably 1:2 to 1:2.8 and more preferably 1:2 to 1:2.6 which have water contents below 15% by weight, based on the weight of the silicate. Conventional amorphous silicates, so-called "waterglasses", have residual water contents of 17 to 20% by weight, so that the term "overdried" in the context of the present specification means that the water content of the silicate used is below 15% by weight. Overdried amorphous silicates which dissolve with delay and which have multiple wash cycle properties are preferably used in the process according to the invention. The delayed disintegration compared with conventional amorphous sodium silicates may have been achieved in various ways, for example by surface treatment, compounding, compacting/compression or solely by overdrying. In the context of the invention, the term "amorphous" encompasses "X-ray amorphous". This means that, in X-ray diffraction experiments, the silicates do not produce any of the sharp X-ray reflexes typical of crystalline substances, but at best one or more maxima of the scattered X-radiation with a width of several degrees of the diffraction angle. However, very favorable builder properties may well be achieved where the silicate particles produce fused or even sharp diffraction maxima in electron diffraction experiments. This may be interpreted to mean that the products have microcrystalline regions ranging from 10 to a few hundred nm in size, values up to at most 50 nm and, more particularly, up to at most 20 5 nm being preferred. So-called X-ray amorphous silicates such as these, which also dissolve with delay compared with conventional waterglasses, are described for example in German patent application DE-A-44 00 024 (Henkel). The silicate compounds may also contain, for example, other builders in quantities below 10% by weight. Silicate/sodalnonionic surfactant compounds are used with particular advantage in the process according to the invention.

The water introduced into the process in accordance with the invention is applied to the silicate particles during the preparation of the compound to be tabletted (the particulate detergent composition). The water may either be pure water or an aqueous solution of active ingredients and auxiliaries typically used in detergents. The water or the aqueous solutions is/are added in quantities of 1 to 15% by weight, based on the weight of the tablets, during the granulation process, quantities of 2 to 10% by weight being preferred and quantities of 3 to 8% by weight (based on the weight of the tablet) being particularly preferred. Pure water containing no dissolved substances is preferably added.

If the process according to the invention is carried out using an overdried amorphous silicate, polyethylene glycol and water, the tablets obtained are stable and do not harden any further in storage. If a silicate of relatively high water content is used from the outset rather than adding the water separately, unstable tablets which do not harden any further in storage and have extremely poor fracture resistances are obtained for otherwise the same procedure (tabletting pressure, time, temperature). The use of overdried waterglasses having water contents below 15% by weight and the addition of water are crucial to the success of the process according to the invention.

Anionic, nonionic, cationic and/or amphoteric surfactants may be used in the particulate detergent composition to be tabletted. Mixtures of anionic and nonionic surfactants in which the anionic surfactants should outweigh the nonionic surfactants, are preferred from the performance point of view. The total surfactant content of the tablets is between 5 and 60% by weight, based on the weight of the tablet, surfactant contents above 15% by weight being preferred.

Suitable anionic surfactants are, for example, those of the sulfonate and sulfate type. Suitable surfactants of the sulfonate type are preferably $C_{9-13}$ alkyl benzenesulfonates, olefin sulfonates, i.e. mixtures of alkene and hydroxyalkane sulfonates, and the disulfonates obtained, for example, from $C_{12-18}$ monoolefins with an internal or terminal double bond by sulfonation with gaseous sulfur trioxide and subsequent alkaline or acidic hydrolysis of the sulfonation products. Other suitable surfactants of the sulfonate type are the alkane sulfonates obtained from $C_{12-18}$ alkanes, for example by sulfochlorination or sulfoxidation and subsequent hydrolysis or neutralization. The esters of α-sulfofatty acids (ester sulfonates), for example the a-sulfonated methyl esters of hydrogenated coconut oil, palm kernel oil or tallow fatty acids, are also suitable.

Other suitable anionic surfactants are sulfonated fatty acid glycerol esters. Fatty acid glycerol esters in the context of the present invention are the monoesters, diesters and triesters and mixtures thereof which are obtained where production is carried out by esterification of a monoglycerol with 1 to 3 moles of fatty acid or in the transesterification of triglycerides with 0.3 to 2 moles of glycerol. Preferred sulfonated fatty acid glycerol esters are the sulfonation products of saturated fatty acids containing 6 to 22 carbon atoms, for example caproic acid, caprylic acid, capric acid, myristic acid, lauric acid, palmitic acid, stearic acid or behenic acid.

Suitable surfactants of the sulfate type are the sulfuric acid monoesters of primary alcohols of natural and synthetic origin. Preferred alk(en)yl sulfates are the alkali metal salts and, in particular, the sodium salts of the sulfuric acid semiesters of $C_{12-18}$ fatty alcohols, for example cocofatty alcohol, tallow fatty alcohol, lauryl, myristyl, cetyl or stearyl alcohol, or $C_{10-20}$ oxoalcohols and the corresponding semiesters of secondary alcohols with the same chain length. Other preferred alk(en)yl sulfates are those with the chain length mentioned which contain a synthetic, linear alkyl chain based on a petrochemical and which are similar in their degradation behavior to the corresponding compounds based on oleochemical raw materials. $C_{16-18}$ alk(en)yl sulfates are particularly preferred from the point of view of washing technology. It can also be of particular advantage, especially for machine detergents, to use $C_{16-18}$ alk(en)yl sulfates in combination with relatively low-melting anionic surfactants and, in particular, with anionic surfactants which have a lower Krafft point and which have a lower tendency to crystallize at relatively low washing temperatures, for example from room temperature to 40° C. In one preferred embodiment of the invention, therefore, the detergents contain mixtures of short-chain and long-chain fatty alkyl sulfates, preferably $C_{12-18}$ fatty alkyl sulfates or mixtures of $C_{12-14}$ fatty alkyl sulfates or $C_{12-18}$ fatty alkyl sulfates with $C_{16-18}$ fatty alkyl sulfates and, more particularly, $C_{12-16}$ fatty alkyl sulfates with $C_{16-18}$ fatty alkyl sulfates. However, another preferred embodiment of the invention is characterized by the use of unsaturated alkenyl sulfates with an alkenyl chain length of preferably $C_{16}$ to $C_{22}$ in addition to saturated alkyl sulfates. In this embodiment, mixtures of saturated sulfonated fatty alcohols consisting predominantly of $C_{16}$ and unsaturated, sulfonated fatty alcohols consisting predominantly of $C_{18}$, for example those derived from solid or liquid fatty alcohol mixtures of the HD-Ocenol® type (a product of Henkel KGaA), are particularly preferred. Ratios by weight of alkyl sulfates to alkenyl sulfates of 10:1 to 1:2 are preferred, ratios by weight of about 5:1 to 1:1 being particularly preferred. Other suitable anionic surfactants are 2,3-alkyl sulfates which may be produced, for example, by addition of sulfuric acid to a-olefins.

The sulfuric acid monoesters of linear or branched $C_{7-21}$ alcohols ethoxylated with 1 to 6 moles of ethylene oxide, such as 2-methyl-branched $C_{9-11}$, alcohols containing on average 3.5 moles of ethylene oxide (EO) or $C_{12-18}$ fatty alcohols containing 1 to 4 EO, are also suitable. In view of their high foaming capacity, they are only used in relatively small quantities, for example in quantities of 1 to 5% by weight, in detergents.

Other suitable anionic surfactants are the salts of alkyl sulfosuccinic acid which are also known as sulfosuccinates or as sulfosuccinic acid esters and which represent the monoesters and/or diesters of sulfosuccinic acid with alcohols, preferably fatty alcohols and, more particularly, ethoxylated fatty alcohols. Preferred sulfosuccinates contain $C_{8-18}$ fatty alcohol radicals or mixtures thereof. Particularly preferred sulfosuccinates contain a fatty alcohol radical derived from ethoxylated fatty alcohols which, regarded in isolation, represent nonionic surfactants (for a description, see below). Of these, sulfosuccinates of which the fatty alcohol radicals are derived from ethoxylated fatty alcohols with a narrow homolog distribution are particularly preferred. Alk(en)yl succinic acid preferably containing 8 to 18 carbon atoms in the alk(en)yl chain or salts thereof may also be used.

Other suitable anionic surfactants are, in particular, soaps. Suitable soaps are saturated fatty acid soaps, such as the salts of lauric acid, myristic acid, palmitic acid, stearic acid, hydrogenated erucic acid and behenic acid, and soap mixtures derived in particular from natural fatty acids, for example coconut oil, palm kernel oil or tallow fatty acids.

The anionic surfactants, including the soaps, may be present in the form of their sodium, potassium or ammonium salts and as soluble salts of organic bases, such as mono-, di- or triethanolamine. The anionic surfactants are preferably present in the form of their sodium or potassium salts and, more preferably, in the form of their sodium salts.

Preferred nonionic surfactants are alkoxylated, advantageously ethoxylated, more particularly primary alcohols preferably containing 8 to 18 carbon atoms and an average of 1 to 12 moles of ethylene oxide (EO) per mole of alcohol, in which the alcohol radical may be linear or, preferably, 2-methyl-branched or may contain linear and methyl-branched radicals in the form of the mixtures typically present in oxoalcohol radicals. However, alcohol ethoxylates containing linear radicals of alcohols of native origin with 12 to 18 carbon atoms, for example coconut oil fatty alcohol, palm oil fatty alcohol, tallow fatty alcohol or oleyl alcohol, and an average of 2 to 8 EO per mole of alcohol are particularly preferred. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, $C_{12-18}$alcohols containing 3 EO, 5 EO or 7 EO and mixtures thereof, such as mixtures of $C_{12-14}$ alcohol containing 3 EO and $C_{12-18}$ alcohol containing 5 EO. The degrees of ethoxylation mentioned are statistical mean values which, for a special product, may be either a whole number or a broken number.

Preferred alcohol ethoxylates have a narrow homolog distribution (narrow range ethoxylates, NRE). In addition to these nonionic surfactants, fatty alcohols containing more than 12 EO may also be used. Examples of such fatty alcohols are tallow fatty alcohol containing 14 EO, 25 EO, 30 EO or 40 20 EO.

In addition, alkyl glycosides corresponding to the general formula $RO(G)_x$ may be used as further nonionic surfactants. In this general formula, R is a primary, linear or methyl-branched, more particularly 2-methyl-branched, aliphatic radical containing 8 to 22 and preferably 12 to 18 carbon atoms and G is a glycose unit containing 5 or 6 carbon atoms, preferably glucose. The degree of oligomerization x, which indicates the distribution of monoglycosides and oligoglycosides, is a number of 1 to 10 and preferably a number of 1.2 to 1.4.

Another class of preferred nonionic surfactants which are used either as sole nonionic surfactant or in combination with other nonionic surfactants, are alkoxylated, preferably ethoxylated or ethoxylated and propoxylated, fatty acid alkyl esters preferably containing 1 to 4 carbon atoms in the alkyl chain, more particularly the fatty acid methyl esters which are described, for example, in Japanese patent application JP 58/217598 or which are preferably produced by the process described in International patent application WO-A-90/13533.

Nonionic surfactants of the amine oxide type, for example N-cocoalkyl-N,N-dimethylamine oxide and N-tallowalkyl-N,N-dihydroxyethyl amine oxide, and the fatty acid alkanolamide type are also suitable. The quantity in which these nonionic surfactants are used is preferably no more, in particular no more than half, the quantity of ethoxylated fatty alcohols used.

Other suitable surfactants are polyhydroxyfatty acid amides corresponding to formula (I):

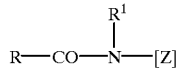

(I)

in which RCO is an aliphatic acyl radical containing 6 to 22 carbon atoms, $R^1$ is hydrogen, an alkyl or hydroxyalkyl radical containing I to 4 carbon atoms and [Z] is a linear or branched polyhydroxyalkyl radical containing 3 to 10 carbon atoms and 3 to 10 hydroxyl groups. The polyhydroxyfatty acid amides are known substances which normally may be obtained by reductive amination of a reducing sugar with ammonia, an alkylamine or an alkanolamine and subsequent acylation with a fatty acid, a fatty acid alkyl ester or a fatty acid chloride.

The group of polyhydroxyfatty acid amides also includes compounds corresponding to formula (II):

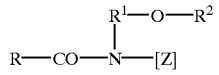

(II)

in which R is a linear or branched alkyl or alkenyl group containing 7 to 12 carbon atoms, $R^1$ is a linear, branched or cyclic alkyl group or an aryl group containing 2 to 8 carbon atoms and $R^2$ is a linear, branched or cyclic alkyl group or an aryl group or a hydroxyalkyl group containing 1 to 8 carbon atoms, $C_{1-4}$ alkyl or phenyl groups being preferred, and [Z] is a linear polyhydroxyalkyl group, of which the alkyl chain is substituted by at least two hydroxyl groups, or alkoxylated, preferably ethoxylated or propoxylated, derivatives of such a group.

[Z] is preferably obtained by reductive amination of a reduced sugar, for example glucose, fructose, maltose, lactose, galactose, mannose or xylose. The N-alkoxy or N-aryloxy-substituted compounds may then be converted into the required polyhydroxyfatty acid amides by reaction with fatty acid methyl esters in the presence of an alkoxide as catalyst, for example in accordance with the teaching of International patent application WO-A-95/07331.

Besides the overdried amorphous silicates used in accordance with the invention, other builders and co-builders may be used in the detergent compositions. These include, in particular, zeolites, citrates and polymeric polycarboxylates.

The finely crystalline, synthetic zeolite containing bound water used in accordance with the invention is preferably zeolite A and/or P. Zeolite MAP® (a commercial product of Crosfield) is particularly preferred as the zeolite P. However, zeolite X and mixtures of A, X and/or P are also suitable. The zeolite may be used in the form of a spray-dried powder or even as an undried stabilized suspension still moist from its production. Where the zeolite is used in the form of a suspension, the suspension may contain small additions of nonionic surfactants as stabilizers, for example 1 to 3% by weight, based on zeolite, of ethoxylated $C_{12-18}$ fatty alcohols containing 2 to ethylene oxide groups, $C_{12-14}$ fatty alcohols containing 4 to 5 ethylene oxide groups or ethoxylated isotridecanols. Suitable zeolites have an average particle size of less than 10 $\mu$m (volume distribution as measured by the Coulter Counter Method) and contain preferably 18 to 22% by weight and, more preferably, 20 to 22% by weight of bound water.

The generally known phosphates may of course also be used as builders providing this is not ecologically problematical. Suitable phosphate builders are, in particular, the sodium salts of the orthophosphates, pyrophosphates and, in particular, the tripolyphosphates. Their content is generally not more than 25% by weight and preferably not more than 20% by weight, based on the final detergent. In some cases, it has been found that tripolyphosphates in particular lead to a synergistic improvement in multiple wash cycle performance in combination with other builders, even in small quantities of up to at most 10% by weight, based on the final detergent.

Useful organic builders are, for example, the polycarboxylic acids usable in the form of their sodium salts, such as citric acid, adipic acid, succinic acid, glutaric acid, tartaric acid, sugar acids, aminocarboxylic acids, nitrilotriacetic acid (NTA), providing their use is not ecologically objectionable, and mixtures thereof. Preferred salts are the salts of polycarboxylic acids, such as citric acid, adipic acid, succinic acid, glutaric acid, tartaric acid, sugar acids and mixtures thereof.

The acids per se may also be used. Besides their builder effect, the acids also typically have the property of an acidifying component and, hence, are also used to establish a relatively low and mild pH value in detergents.

Particularly suitable acids are citric acid, succinic acid, glutaric acid, adipic acid, gluconic acid and mixtures thereof.

Other suitable organic builders are dextrins, for example oligomers and polymers of carbohydrates which may be obtained by partial hydrolysis of starches. The hydrolysis may be carried out by standard methods, for example acid- or enzyme-catalyzed methods. The end products are preferably hydrolysis products with average molecular weights of 400 to 500,000. A polysaccharide with a dextrose equivalent (DE) of 0.5 to 40 and, 5 more particularly, 2 to 30 is preferred, the DE being an accepted measure of the reducing effect of a polysaccharide by comparison with dextrose which has a DE of 100. Both maltodextrins with a DE of 3 to 20 and dry glucose sirups with a DE of 20 to 37 and also so-called yellow dextrins and white dextrins with relatively high molecular weights of 2,000 to 30,000 may be 10 used. A preferred dextrin is described in British patent application 94 19 091. The oxidized derivatives of such dextrins are their reaction products with oxidizing agents which are capable of oxidizing at least one alcohol function of the saccharide ring to the carboxylic acid function. Dextrins thus oxidized and processes for their production are known, for example, from European 15 patent applications EP-A-0 232 202, EP-A-0 427 349, EP-A-0 472 042 and EP-A-0 542 496 and from International patent applications WO-A-92/18542, WO-A-93/08251, WO-A-94/28030, WO-A-95/07303, WO-A-95112619 and WO-A-95/20608. A product oxidized at $C_6$ of the saccharide ring can be particularly advantageous.

Other suitable co-builders are oxydisuccinates and other derivatives of disuccinates, preferably ethylenediamine disuccinate. The glycerol disuccinates and glycerol trisuccinates described, for example, in US-PSS 4,524,009 and 4,639,325, in European patent application EP-A-0 150 930 and in Japanese patent application JP 93/339896 are also particularly preferred in this regard. Suitable quantities for zeolite-containing and/or silicate-containing formulations are between 3 and 15% by weight.

Other useful organic co-builders are, for example, acetylated hydroxycarboxylic acids and salts thereof which may even be present in lactone form and which contain at least 4 carbon atoms, at least one hydroxy group and at most two acid groups. Co-builders such as these are described, for example, in International patent application WO-A-95/20029.

Suitable polymeric polycarboxylates are, for example, the sodium salts of polyacrylic acid or polymethacrylic acid, for example those having a relative molecular weight of 800 to 150,000 (based on acid). Suitable copolymeric polycarboxylates are, in particular, those of acrylic acid with methacrylic acid and those of acrylic acid or methacrylic acid with maleic acid. Copolymers of acrylic acid with maleic acid which contain 50 to 90% by weight of acrylic acid and 50 to 10% by weight of maleic acid have proved to be particularly suitable. Their relative molecular weight, based on free acids, is generally in the range from 5,000 to 200,000, preferably in the range from 10,000 to 120,000 and more preferably in the range from 50,000 to 100,000.

The (co)polymeric polycarboxylates may be used either in the form of a powder or in the form of an aqueous solution, 20 to 55% by weight aqueous solutions being preferred.

Also particularly preferred are biodegradable polymers of more than two different monomer units, for example those which contain salts of acrylic acid and maleic acid and vinyl alcohol or vinyl alcohol derivatives as monomers in accordance with DE-A-43 00 772 or salts of acrylic acid and 2-alkyl allyl sulfonic acid and sugar derivatives as monomers in accordance with DE-C-42 21 381.

Other preferred copolymers are those which are described in German patent applications DE-A-43 03 320 and DE-A-44 17 734 and which preferably contain acrolein and acrylic acid/acrylic acid salts or acrolein and vinyl acetate as monomers.

Other suitable builders are oxidation products of carboxyl-containing polyglucosans and/or water-soluble salts thereof which are described, for example, in International patent application WO-A-93/08251 or of which the production is described, for example, in International patent application WO-A-93/16110. Oxidized oligosaccharides according to earlier German patent application 196 00 018.1 are also suitable.

Polymeric aminodicarboxylic acids and salts or precursors thereof are also mentioned as other preferred builders. Polyaspartic acids and salts or derivatives thereof, which are said to have a bleach-stabilizing effect in addition to co-builder properties in German patent application 195 40 086.0, are particularly preferred.

Other suitable builders are polyacetals which may be obtained by reaction of dialdehydes with polyol carboxylic acids containing 5 to 7 carbon atoms and at least three hydroxyl groups, for example as described in European patent application EP-A-0 280 223. Preferred polyacetals are obtained from dialdehydes, such as glyoxal, glutaraldehyde, terephthalaldehyde and mixtures thereof and from polyol carboxylic acids, such as gluconic acid and/or glucoheptonic acid.

In addition to the ingredients mentioned, the detergent tablets may contain known additives typically used in detergents, for example bleaching agents and bleach activators, foam inhibitors, optical brighteners, enzymes, enzyme stabilizers, small quantities of neutral filling salts and dyes and fragrances, opacifiers or pearlescers.

Among the compounds yielding $H_2O_2$ in water which serve as bleaching agents, sodium perborate tetrahydrate and sodium perborate monohydrate are particularly important.

Other useful bleaching agents are, for example, sodium percarbonate, peroxypyrophosphates, citrate perhydrates and $H_2O_2$-yielding peracidic salts or peracids, such as perbenzoates, peroxophthalates, diperazelaic acid, phthaloimino peracid or diperdodecanedioic acid. The content of peroxy bleaching agents in the detergents is preferably from 1 to 40% by weight and more preferably from 10 to 20% by weight, perborate monohydrate or percarbonate advantageously being used.

In order to obtain an improved bleaching effect where washing is carried out at temperatures of 60° C. or lower, bleach activators may be incorporated in the preparations. Suitable bleach activators are compounds which yield aliphatic peroxocarboxylic acids preferably containing 1 to 10 carbon atoms and more preferably 2 to 4 carbon atoms and/or optionally substituted perbenzoic acid under perhydrolysis conditions. Compounds bearing O- and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexahydro-1,3,5-triazine (DADHT), acylated glycolurils, more particularly tetraacetyl glucoluril (TAGU), N-acylimides, more particularly N-nonanoyl succinimide (NOSI), acylated phenol sulfonates, more particularly n-nonanoyl or isononanoyloxybenzenesulfonate (n- or iso-NOBS), carboxylic anhydrides, more particularly phthalic anhydride, acylated polyhydric alcohols, more particularly triacetin, ethylene glycol diacetate, 2,5-diacetoxy-2,5-dihydrofuran and the enol esters known from German patent applications DE 196 16 693 and DE 196 16 767, acetylated sorbitol and mannitol and the mixtures thereof (SORMAN) described in European patent application EP 0 525 239, acylated sugar derivatives, more particularly pentaacetyl glucose (PAG), pentaacetyl fructose, tetraacetyl xylose and octaacetyl lactose, and acetylated, optionally N-alkylated glucamine and gluconolactone, and/or N-acylated lactams, for example N-benzoyl caprolactam, which are known from International patent applications WO 94/27970, WO 94/28102, WO 94/28103, WO 95/00626, WO 95/14759 and WO 95117498. The substituted hydrophilic acyl acetals known from German patent application DE 196 16 769 and the acyl lactams described in German patent application DE 196 16 770 and in International patent application WO 95/14075 are also preferably used. The combinations of conventional bleach activators known from German patent application DE 44 43 177 may also be used. Bleach activators such as these are present in the usual quantities, preferably in quantities of 1% by weight to 10% by weight and more preferably in quantities of 2% by weight to 8% by weight, based on the detergent as a whole.

In addition to or instead of the conventional bleach activators mentioned above, the sulfonimines known from European patents EP 0 446 982 and EP 0 453 003 and/or bleach-boosting transition metal salts or transition metal complexes may also be present as so-called bleach catalysts. Suitable transition metal compounds include, in particular, the manganese-, iron-, cobalt-, ruthenium- or molybdenum-salen complexes known from German patent application DE 195 29 905 and the N-analog compounds thereof known from German patent application DE 196 20 267, the manganese-, iron-, cobalt-, ruthenium- or molybdenum-carbonyl complexes known from German patent application DE 195 36 082, the manganese, iron, cobalt, ruthenium, molybdenum, titanium, vanadium and copper complexes with nitrogen-containing tripod ligands described in German patent application DE 196 05 688, the cobalt-, iron-, copper- and ruthenium-ammine complexes known from German patent application DE 196 20 411, the manganese, copper and cobalt complexes described in German patent application DE 44 16 438, the cobalt complexes described in European patent application EP 0 272 030, the manganese complexes known from European patent application EP 0 693 550, the manganese, iron, cobalt and copper complexes known from European patent EP 0 392 592 and/or the manganese complexes described in European patent EP 0 443 651 or in European patent applications EP 0458 397, EP 0458 398, EP 0 549 271, EP 0 549 272, EP 0 544 490 and EP 0 544 519. Combinations of bleach activators and transition metal bleach catalysts are known, for example, from German patent application DE 196 13 103 and from International patent application WO 95/27775. Bleach-boosting transition metal complexes, more particularly containing the central atoms Mn, Fe, Co, Cu, Mo, V, Ti and/or Ru, are used in the usual quantities, preferably in a quantity of up to 1% by weight, more preferably in a quantity of 0.0025% by weight to 0.25% by weight and most preferably in a quantity of 0.01% by weight to 0.1% by weight, based on the detergent as a whole.

In addition, the detergents/cleaners may also contain components with a positive effect on the removability of oil and fats from textiles by washing. This effect becomes particularly clear when a textile which has already been repeatedly washed with a detergent according to the invention containing this oil- and fat-dissolving component is soiled. Preferred oil- and fat-dissolving components include, for example, nonionic cellulose ethers, such as methyl cellulose and methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derivatives thereof. Of these, the sulfonated derivatives of phthalic and terephthalic acid polymers are particularly preferred.

According to the teaching of International patent application WO-A-94/29419, alkali metal carbonates may also be replaced by sulfur-free amino acids containing 2 to 11 carbon atoms and optionally another carboxyl and/or amino group and/or by salts thereof. According to the invention, the alkali metal carbonates may be completely or partly replaced by glycine or glycinate.

It can be of advantage to add typical foam inhibitors to the detergents where they are used for machine washing. Suitable foam inhibitors are, for example, soaps of natural or synthetic origin with a high percentage content of $C_{18-24}$ fatty acids. Suitable non-surface-active foam inhibitors are, for example, organopolysiloxanes and mixtures thereof with microfine, optionally silanized silica and also paraffins, waxes, microcrystalline waxes and mixtures thereof with silanized silica or bis-stearyl ethylenediamide. Mixtures of various foam inhibitors, for example mixtures of silicones, paraffins or waxes, are also used with advantage. The foam inhibitors, more particularly silicone- or paraffin-containing foam inhibitors, are preferably fixed to a granular water-soluble or water-dispersible support. Mixtures of paraffins and bis-stearyl ethylenediamides are particularly preferred.

The neutrally reacting sodium salts of, for example, 1-hydroxyethane-1,1-diphosphonate, diethylenetriamine pentamethylene phosphonate or ethylenediamine tetramethylene phosphonate are preferably used in quantities of 0.1 to 1.5% by weight as the salts of polyphosphonic acids.

Suitable enzymes are those from the class of proteases, lipases, amylases, cellulases and mixtures thereof. Enzymes obtained from bacterial strains or fungi, such as *Bacillus subtilis, Bacillus licheniformis and Streptomyces griseus* are particularly suitable. Proteases of the subtilisin type are preferably used, proteases obtained from *Bacillus lentus* being particularly suitable. Enzyme mixtures, for example mixtures of protease and amylase or protease and lipase or protease and cellulase or mixtures of cellulase and lipase or mixtures of protease, amylase and lipase or protease, lipase and cellulase, but especially cellulase-containing mixtures, are of particular interest. (Per)oxidases have also proved to be suitable in some cases. The enzymes may be adsorbed to supports and/or encapsulated in shell-forming substances to protect them against premature decomposition. The percentage content of enzymes, enzyme mixtures or enzyme granules may be, for example, of the order of 0.1 to 5% by weight and preferably from 0.1 to around 2% by weight.

The tablets may contain derivatives of diaminostilbene disulfonic acid or alkali metal salts thereof as optical brighteners. Suitable optical brighteners are, for example, salts of 4,4'-bis-(2-anilino-4-morpholino-1,3,5-triazinyl-6-amino)-stilbene-2,2'-disulfonic acid or compounds of similar composition which contain a diethanolamino group, a methylamino group, an anilino group or a 2-methoxyethylamino group instead of the morpholino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)-4'-(2-sulfostyryl)-diphenyl, may also be present. Mixtures of the brighteners mentioned above may also be used.

After tabletting, the detergent tablets have an initial stability which increases further through gradual post-hardening. Post-hardening times of several days are normally necessary, at the end of which fracture resistance can have increased by a factor of 2 to 3. Shortly after their production, detergent tablets obtained by the process according to the invention have high fracture resistances which increase within 2 hours to around 90% of their final value. A further increase in fracture resistance during storage is not observed. The fracture resistance of cylindrical tablets can be determined through the diametral fracture stress which in turn may be determined in accordance with the following equation:

$$\sigma=2P/\pi Dt$$

where σ stands for the diametral fracture stress (DFS) in Pa, P is the force in N which leads to the pressure exerted on the tablet, causing it to fracture, D is the tablet diameter in meters and t is the height of the tablet.

The dissolving rate or rather the residue behavior of the tablets can be determined by several tests. To measure the disintegration rate, a tablet was added through a conventional dispenser to 3.5 kg of dry laundry in a washing machine (Miele Novotronic W 918). After water had run in, the dispenser was weighed with the tablet. A coloreds program (40° C., 11 l water, 16°d) was then carried out. The program was interrupted after 5 and 10 minutes and the dispenser was weighed with the tablet remains. The test result is expressed as the residue in % by weight of the initial value. To determine the disintegration rate in units of time, an online washing machine (Miele Deluxe W 717) equipped with a conductivity measuring cell was charged with 4.5 kg of ballast laundry and, after the addition of a tablet, a wash program (40° C., 17 l water, 16° d) was started. The time it takes for the conductivity to become constant corresponds to the time the tablet requires to dissolve completely.

EXAMPLES

Tablets E1 to E5 characterized by the physical data set out in Table 2 below were obtained by tabletting a particulate compound (for composition, see Table 1). Comparison Examples C1 to C5 in Table 2 were taken from the patent literature. Comparison Examples S1 and S2 correspond in their composition to Example E3 according to the invention except that the overdried amorphous silicate was replaced by a waterglass with a "normal" water content of 18% by weight and the quantity of free water added was reduced accordingly.

TABLE 1

| | Composition [% by weight] | | | | |
|---|---|---|---|---|---|
| | E1 | E2 | E3 | E4 | E5 |
| Alkyl polyglycoside | 3.34 | 3.34 | 7.56 | 3.31 | 4.13 |
| $C_{12-14}$ fatty alcohol sulfate | 3.85 | 3.86 | — | 3.77 | 5.21 |
| $C_{12-18}$ fatty alcohol sulfate | 15.39 | 15.42 | — | 15.07 | 12.32 |
| $C_{12-16}$ tallow alcohol sulfate | — | — | 14.07 | — | — |
| Sodium sulfate | 5.13 | 5.14 | — | 5.02 | 4.21 |
| Sodium citrate | 14.30 | 18.24 | 11.97 | 14.01 | 16.20 |
| Sokalan-CP5 ® | 4.33 | 4.32 | 5.40 | 4.25 | 4.20 |
| Phosphonate | 0.41 | 0.41 | 0.53 | 0.51 | 0.40 |
| Waterglass | 11.67 | 9.08 | 18.15 | 11.46 | 12.71 |
| Soil repellent | 0.97 | 1.00 | 1.00 | 0.95 | 0.97 |
| Foam inhibitor | 3.45 | 3.50 | 3.50 | 3.38 | 3.38 |
| Protease | 1.53 | 1.50 | 1.56 | 1.51 | 1.50 |
| Tylose | 0.26 | 0.24 | 0.48 | 0.46 | 0.25 |
| Optical brightener | 0.13 | 0.13 | 0.14 | 0.13 | 0.15 |
| Sodium percarbonate | 17.76 | 17.00 | 17.50 | 17.40 | 16.50 |
| TAED | 7.13 | 7.13 | 7.25 | 7.00 | 6.24 |
| Perfume | 0.26 | 0.30 | 0.25 | 0.25 | 0.20 |
| PEG 4000 | 2.05 | 2.00 | 2.00 | 3.98 | 6.22 |
| Other salts | 1.05 | 1.07 | 0.98 | 1.47 | 0.87 |
| Water | 6.99 | 6.33 | 7.66 | 6.07 | 4.34 |
| Total surfactant content | 22.58 | 22.62 | 21.63 | 22.15 | 21.66 |

Sokalan CP5 ® is an acrylic acid/maleic acid copolymer of BASF

TABLE 2

| | Physical data of the tablets [units: see Table] | | | | | | | | | |
|---|---|---|---|---|---|---|---|---|---|---|
| | E1 | E1 | E3 | E4 | E5 | C1 | C2 | C3 | C4 | C5 |
| Tablet height [cm] | 2 | 2 | 2.7 | 2.3 | 2.4 | 1 | 2.5 | 2.5 | 2 | 2 |
| Tablet diameter [cm] | 4.4 | 4.4 | 5 | 5 | 5 | 4 | 4.5 | 4.5 | 4.5 | 4.5 |
| Tablet weight [g] | 25 | 25 | 40 | 40 | 40 | n.m. | n.m. | n.m. | 50 | 50 |
| Density [g/cm$^3$] | 0.82 | 0.82 | 0.75 | 0.89 | 0.85 | n.m. | 1.24 | 1.39 | 1.25 | 1.40 |
| Tabletting force [kN] | <10 | <10 | 0.2 | 0.2 | 0.2 | 0.126 | 0.9 | 3.3 | 1.1 | 2.8 |
| Tabletting pressure [N/cm$^2$] | <6.6 | <6.6 | 10.2 | 10.2 | 10.2 | 10.0 | 56.6 | 207 | 69.2 | 176 |

TABLE 2-continued

| Physical data of the tablets [units: see Table] | E1 | E1 | E3 | E4 | E5 | C1 | C2 | C3 | C4 | C5 |
|---|---|---|---|---|---|---|---|---|---|---|
| Fracture resistance [kPa] | 44.9 | 35.4 | 28.3 | 67.0 | 57.8 | 28.6 | 7.5 | 19 | 4.5 | 15 |
| Residue [% by weight]* | 0 | 0 | 0 | 0 | 0 | 0 | 0 | 70 | 0 | 85 |
| Dissolving time [mins.] | 8 | 5 | 5 | 3.5 | 4.5 | n.m. | n.m. | n.m. | n.m. | n.m. |

*after 10 minutes
n.m. not mentioned
C1: detergent tablet with individually coated constituents of defined size, coating of polymer (branched polyvinyl pyrrolidone) produced in accordance with EP-A-0 522 766
C2, C3: detergent tablet containing a sodium citrate with a certain solubility produced in accordance with EP-A-0 711 827
C4, C5: detergent tablet containing 4.8% by weight of PEG 4000 as binder produced in accordance with EP-A-0 711 828

If the overdried amorphous silicate ("overdried waterglass") is replaced by a non-overdried waterglass with a water content of 18% by weight and the amount of water added is reduced accordingly (Comparison Examples S1 and S2), the mixture does not form any tablets at tabletting forces of 200 N, i.e. tablet destruction occurs through instability on ejection from the tabletting press (S1). Stable tablets could only be obtained with tabletting forces of 25 kN (S2). These tablets are distinguished by poor solubility and by high residue formation.

TABLE 3

| Physical data of the tablets [units: see Table] | E1 | E2 | E3 | E4 | E5 | S1 | S2 |
|---|---|---|---|---|---|---|---|
| Tablet height [cm] | 2 | 2 | 2.7 | 2.3 | 2.4 | 2.7 | 2.7 |
| Tablet diameter [cm] | 4.4 | 4.4 | 5 | 5 | 5 | 5 | 5 |
| Tablet weight [g] | 25 | 25 | 40 | 40 | 40 | 40 | 40 |
| Density [g/cm$^3$] | 0.82 | 0.82 | 0.75 | 0.89 | 0.85 | 0.75 | 0.88 |
| Tabletting force [kN] | <10 | <10 | 0.2 | 0.2 | 0.2 | 0.2 | 25 |
| Tabletting pressure [N/cm$^2$] | <6.6 | <6.6 | 10.2 | 10.2 | 10.2 | 10.2 | 1273 |
| Fracture resistance [kPa] | 44.9 | 35.4 | 28.3 | 67.0 | 57.8 | * | 30 |
| Residue [% by weight] | 0 | 0 | 0 | 0 | 0 | — | 20 |
| Dissolving time [mins.] | 8 | 5 | 5 | 3.5 | 4.5 | — | 17 |

*the force applied does not lead to tabletting

What is claimed is:

1. A process of preparing a detergent tablet comprising the steps of:

a) adding 5% to 20% by weight of an overdried amorphous silicate, 0.5% to 10% by weight of polyethylene glycol, and separately adding 1% to 15% by weight of water to a mixer to form a composition for tabletting wherein said composition further comprises builders and/or surfactants; and b) forming a tablet from said composition at a temperature below 50° C. and under a pressure below 15 N/cm$^2$, wherein said weight percents are based on the weight of said tablet.

2. The process as in claim 1 wherein said silicate has an $Na_2O:SiO_2$ ratio of from 1:2 to 1:3.3 and a water content which is present in amounts below 15% by weight.

3. The process as in claim 1 wherein said polyethylene glycol has an average molecular weight of about 4,000.

4. The process as in claim 1 wherein said water is added in an amount of 3% to 8% by weights based on the weight of said tablet.

5. The process as in claim 1 wherein said builders are selected from the group consisting of oligomeric and polymeric polycarboxylates, citrates, and acrylic acid maleic acid copolymers.

6. The process as in claim 1 wherein said surfactants are present in an amount of at least 15% by weight based on the weight of said tablet.

7. The process as in claim 1 wherein said surfactants are selected from the group consisting of anionic surfactants, nonionic surfactants, and mixtures thereof.

8. The process as in claim 7 wherein said nonionic surfactants comprise alkyl polyglycosides.

9. The process as in claim 1 wherein said amorphous silicate is initially added to said mixer with said builders to form a mixture, mixing the mixture and introducing said water, said polyethylene glycol and said surfactants into said mixture with mixing, and tabletting the mixture.

10. A detergent tablet formed from a mixture comprising:

a) 5% to 20% by weight of an overdried amorphous silicate having a water content which is present in amounts below 15 by weight based on the weight of said silicate, b) 0. 5% to 10% by weight of polyethylene glycol, c) 1% to 15% by weight of water, wherein said water is separately added into the mixture, and d) at least one member selected from the group consisting of builders and surfactants wherein said weight percents of the overdried amorphous silicate, the polyethylene glycol and the water are based on the weight of said mixture tablet, and wherein said tablet is formed at a temperature below 50° C. and under a pressure below 15 N/cm $^2$.

11. The tablet as in claim 10 wherein said overdried amorphous silicate has an $Na_2O:SiO_2$ ratio of from 1:2 to 1:3.3.

12. The tablet as in claim 10 wherein said polyethylene glycol has an average molecular weight of about 4,000.

13. The tablet as in claim 10 wherein said water is present in an amount of 3% to 8% by weight, based on the weight of said tablet.

14. The tablet as in claim 10 wherein said builders are selected from the group consisting of oligomeric and polymeric polycarboxylates, citrates, and acrylic acid maleic acid copolymers.

15. The tablet as in claim 10 wherein said surfactants are present in an amount of at least 15% by weight, based on the weight of said tablet.

16. The tablet as in claim 15 wherein said surfactants are selected from the group consisting of anionic surfactants, nonionic surfactants, and mixtures thereof.

17. The tablet as in claim 16 wherein said nonionic surfactants comprise alkyl polyglycosides.

* * * * *

UNITED STATES PATENT AND TRADEMARK OFFICE

CERTIFICATE OF CORRECTION

PATENT NO. : 6,329,335 B1
DATED : December 11, 2001
INVENTOR(S) : Feist et al.

It is certified that error appears in the above-identified patent and that said Letters Patent is hereby corrected as shown below:

Column 15,
Line 52, after “tabletting”, insert -- , --.
Line 64, delete “weights”, and insert therefor -- weight, --.

Column 16,
Lines 18 and 57, delete “acid maleic”, and insert therefor -- acid-maleic --.
Line 21, after “weight”, insert -- , --.
Line 37, delete “0. 5%”, and insert therefor --0.5% --.
Line 44, after “said”, delete “mixture”.

Signed and Sealed this

Sixteenth Day of September, 2003

JAMES E. ROGAN
*Director of the United States Patent and Trademark Office*